US007684749B2

(12) United States Patent
Yamane et al.

(10) Patent No.: US 7,684,749 B2
(45) Date of Patent: Mar. 23, 2010

(54) IMAGE FORMING APPARATUS WITH TRANSFER ATTITUDE CORRECTING SECTION

(75) Inventors: Hideo Yamane, Hachioji (JP); Satoshi Sakata, Hino (JP); Hiroyuki Watanabe, Hachioji (JP); Akifumi Isobe, Hidaka (JP)

(73) Assignee: Konica Minolta Business Technologies, Inc. (JP)

( * ) Notice: Subject to any disclaimer, the term of this patent is extended or adjusted under 35 U.S.C. 154(b) by 1002 days.

(21) Appl. No.: 11/404,224

(22) Filed: Apr. 13, 2006

(65) Prior Publication Data

US 2006/0285903 A1 Dec. 21, 2006

(30) Foreign Application Priority Data

Jun. 17, 2005 (JP) ..... 2005-177509

(51) Int. Cl.

| | |
|---|---|
| ***G03G 15/11*** | (2006.01) |
| ***B65H 7/08*** | (2006.01) |
| ***B65H 7/10*** | (2006.01) |
| *B65H 7/00* | (2006.01) |

(52) U.S. Cl. ..... 399/395; 399/381; 399/394; 399/396; 271/226; 271/227; 271/228

(58) Field of Classification Search ..... 399/361, 399/363, 381, 394, 395, 396; 271/226, 227, 271/228; *B65H 7/10, 7/08; G03G 15/00*
See application file for complete search history.

(56) References Cited

U.S. PATENT DOCUMENTS

| | | | | |
|---|---|---|---|---|
| 5,697,609 | A | 12/1997 | Williams et al. | |
| 6,788,322 | B2 * | 9/2004 | Morita | 347/139 |
| 2005/0035528 | A1 * | 2/2005 | Suga et al. | 271/10.12 |
| 2005/0035539 | A1 | 2/2005 | Hashimoto | |

FOREIGN PATENT DOCUMENTS

| | | | |
|---|---|---|---|
| EP | 0 849 929 | | 6/1998 |
| JP | 01034836 | A * | 2/1989 |
| JP | 04101947 | A * | 4/1992 |
| JP | 10-067448 | | 3/1998 |
| JP | 2005-035709 | | 2/2005 |
| JP | 2005-053646 | | 3/2005 |

OTHER PUBLICATIONS

European search report for 06252133.1-2209, mailed Oct. 16, 2006, 7 pgs.

* cited by examiner

*Primary Examiner*—Judy Nguyen
*Assistant Examiner*—'Wyn' Q Ha
(74) *Attorney, Agent, or Firm*—Squire, Sanders & Dempsey L.L.P.

(57) ABSTRACT

An image forming apparatus has a transfer attitude correcting section for correcting a transfer attitude of the transfer sheet to receive the toner image and for conveying the corrected transfer sheet to the transfer section with a timing to match with the movement of the toner image. The transfer attitude correcting section includes a roller unit including a base board rotatable around a center of rotation and a registration roller mounted on the base board, a detecting section for detecting a position of the transfer sheet being conveyed by the registration roller; and a control section for control the roller unit based on detection data detected by the detecting section so as to correct a skew of the transfer sheet by rotating the base board and to correct a deviation of a transfer position of the transfer sheet by shifting the registration roller on the base board.

13 Claims, 5 Drawing Sheets

IMAGE FORMING APPARATUS WITH TRANSFER ATTITUDE CORRECTING SECTION

BACKGROUND OF THE INVENTION

The present invention relates to an image forming apparatus that forms a toner image on a transfer sheet for outputting, as a copying machine, a printer, a facsimile machine and a multifunctional machine including the aforesaid equipment, and in particular, to control for correcting a transfer attitude of a transfer sheet that is conveyed to a position where a toner image is transferred onto the transfer sheet, wherein the transfer attitude is an attitude to receive a toner image.

In the case of recent image forming apparatuses each being connected with a personal computer, those wherein images and information composed of images and character information (which is also called image information) are inputted, then, printed and outputted are more in terms of a number than those wherein pieces of information composed of characters, figures or of symbols (which is also called character information) are inputted, then, subjected to image forming and outputted.

In the case of outputting image information such as color photos, for example, there are many occasions of the structure wherein an image that is cut off square is fitted in a printable area per page of a transfer sheet. Therefore, if a transfer sheet is conveyed and printed under the condition that the transfer sheet is inclined to the conveyance direction for the transfer sheet (hereinafter referred to as "skew"), a blank space provided between an edge portion of the transfer sheet is inclined because a boundary portion of the square image is in a form of a straight line, and "transfer sheet skew" is more emphasized, resulting in a problem that the transfer sheet skew is interpreted as "image skew" depending on a way of looking at.

Therefore, when outputting image information, the transfer sheet skew is more conspicuous than in the case of outputting character information, thus, it has become a demand that even a slight skew of a transfer sheet which has been allowed so far may also be corrected for conducting forming of high grade images.

In particular, in an image forming apparatus of a type to form a color image by transferring toner images each being formed by each of Y (yellow), M (magenta), C (cyan) and K (black) color toners, and by superposing them, for example, if the skew of a transfer sheet as one mentioned above is caused, a phenomenon called "out of color registration" is generated, and images having lower grade are formed, which has been a problem.

Further, if a transfer sheet deviates in a transverse direction from a transfer standard position, there may be a problem that a transfer position of an image is different for each transfer sheet so that an appearance of the document becomes deteriorated.

Therefore, for correcting the transfer sheet skew of the above kind, there is disclosed a technology capable of correcting the transfer sheet skew which is higher in terms of accuracy than the well-known registration apparatus of a type to correct transfer sheet skew by causing a transfer sheet to hit a pair of rollers.

For example, there is disclosed a technology wherein, when an inclination detection means and a position detection means are arranged at the downstream side of the paired conveyance rollers of the registration apparatus, since detections for a skew of a transfer sheet and for a position of a side edge of the transfer sheet are made under the condition that a recording sheet (transfer sheet) is interposed by the paired conveyance rollers and if the paired conveyance rollers are rotated corresponding to the skew angle showing the skew of the transfer sheet calculated based on the results of the detections, the skew of the transfer sheet can be corrected accurately (for example, see Patent Document 1).

Further, a detection means that detects a skew from the transfer sheet conveyance direction under the condition that sheet S (transfer sheet) is interposed is provided, and when the transfer sheet is skewed, a leading edge position after t sec. after the skew is corrected by swing of a skew correction means is calculated and estimated based on detection signals from a detection means of the skew, and the conveyance speed of the paired registration rollers is calculated depending on an amount of deviation of the leading edge of the transfer sheet after t sec. thus obtained.

Then, based on the results of the calculation, the skew of the transfer sheet is corrected by swinging the skew correction means, so that a leading edge of the transfer sheet and the forefront of an image on the photoreceptor drum may be aligned at the transfer section, and the transfer sheet conveyance speed by the paired registration rollers is adjusted to the conveyance speed obtained by the moment when a leading edge of the transfer sheet arrives at the transfer section, and the transfer sheet is conveyed.

There has been disclosed a technology wherein a skew of the transfer sheet can be corrected extremely accurately without stopping the transfer sheet momentarily, by conveying the transfer sheet to the transfer section at the same speed as the circumferential speed of the photoreceptor drum, after a leading edge of the transfer sheet arrives at the transfer section (for example, see Patent Document 2).

Further, there has been published a technique that a position detecting sensor is arranged in a direction perpendicular to a transfer sheet conveying direction so as to detect an inclination of a transfer sheet by detecting a position on a side edge portion of a transfer sheet along the transfer sheet conveying direction (for example, see Patent Document 3).

(Patent Document 1) TOKUKAIHEI No. 10-67448

(Patent Document 2) TOKUKAI No. 2005-53646

(Patent Document 3) TOKUKAI No. 2005-35709

However, in the Patent Document 1, a left end position or a right end position on a leading edge of the transfer sheet that is in the direction perpendicular to the conveyance direction is not always corrected to the regular position, depending on a position of rotation center of the paired conveyance rollers, although a skew in the direction perpendicular to the conveyance direction is corrected by the rotation of the paired conveyance rollers. Therefore, it is necessary to correct a left end position or a right end position on a leading edge of the transfer sheet to the regular position by moving the transfer sheet in parallel with the direction perpendicular to the conveyance direction. Therefore, when correcting the skew by this parallel movement, the transfer sheet is sometimes skewed again, according to circumstances, which has been a problem.

In the Patent Document 2, a skew correction means is swung based on detection signals coming from a detection means, and a position of the leading edge of the transfer sheet after t sec. from the correction of the skew is estimated, for the correction. Therefore, the timing between the estimation and the actual conveyance speed of the transfer sheet, for example, is not adjusted when occasion demands, resulting in a problem that the skew cannot be corrected sufficiently, although there is an advantage to correct without stopping the transfer sheet momentarily.

In other words, there has been a problem that a skew generated after skew correction and a slight skew that failed to be corrected, for example, cannot be corrected in both the Patent Document 1 and the Patent Document 2, because the skew is corrected based on signals detected once.

Further, although Patent Document 3 discloses a correcting device to correct an inclination of a transfer sheet while sandwiching the transfer sheet, it is necessary to release sandwiching by conveying rollers to convey the transfer sheet during the inclination correction. Accordingly, there is a troublesomeness that the sandwiching operation by the correcting device and the sandwiching operation by the conveying rollers are controlled with timing.

SUMMARY OF THE INVENTION

In view of the problems stated above, the invention provides an image forming apparatus wherein control is simple, a skew of a transfer sheet can be corrected repeatedly, and images of high grade can be formed.

The abovementioned image forming apparatus, comprises:

an image carrying member for carrying a toner image while rotating;

a transfer section for transferring the toner image from the image carrying member to a transfer sheet;

a transfer attitude correcting section for correcting a transfer attitude of the transfer sheet to receive the toner image and for conveying the corrected transfer sheet to the transfer section with a timing to match with the movement of the toner image;

wherein the transfer attitude correcting section comprises:

a roller unit including a base board rotatable around a center of rotation and a registration roller mounted on the base board, a detecting section for detecting a position of the transfer sheet being conveyed by the registration roller; and a control section for control the roller unit based on detection data detected by the detecting section so as to correct a skew of the transfer sheet by rotating the base board and to correct a deviation of a transfer position of the transfer sheet by shifting the registration roller on the base board.

DETAILED DESCRIPTION OF THE PREFERRED EMBODIMENT

Figure 1:
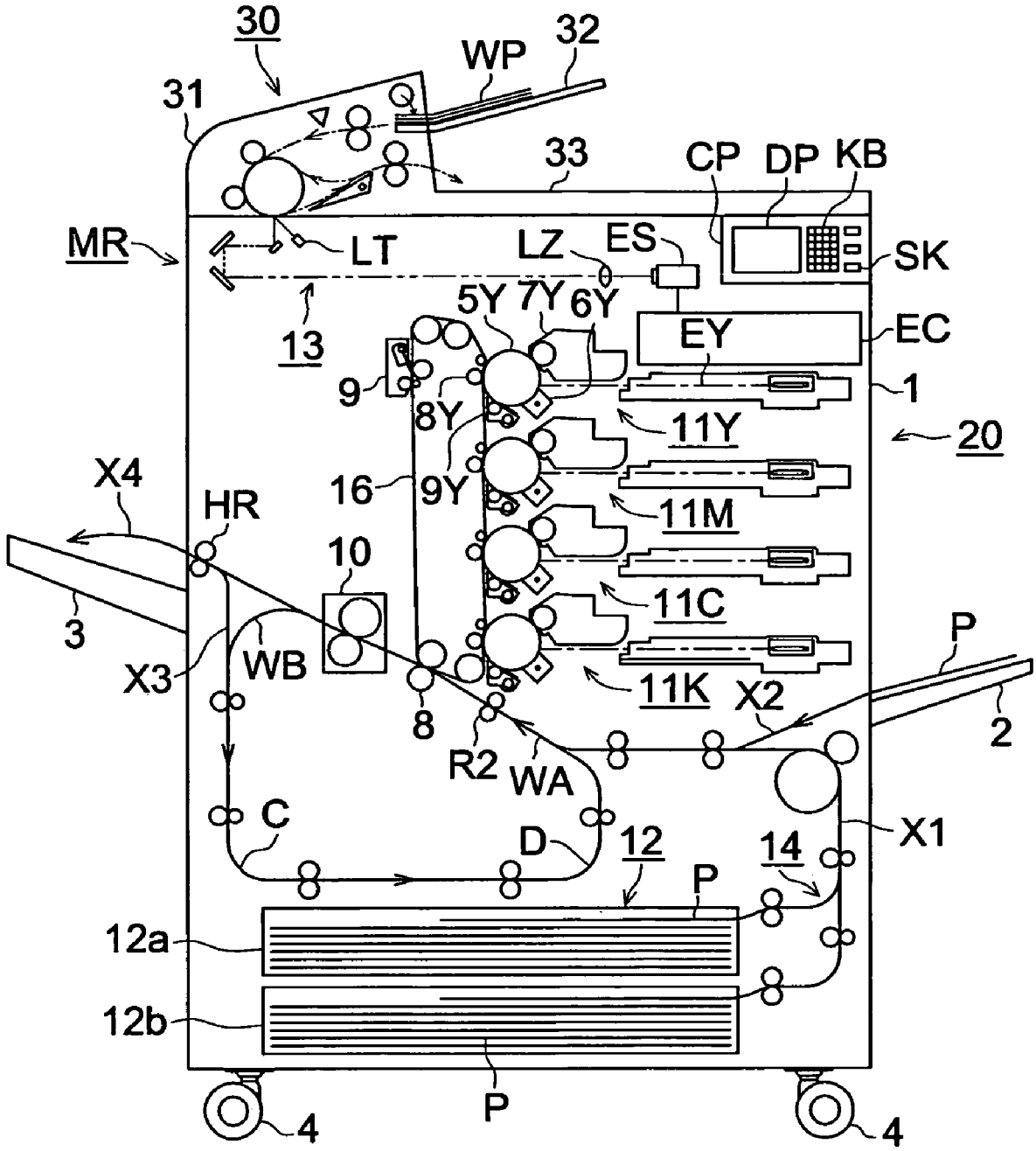
FIG. 1 is a schematic illustration of an image forming apparatus relating to the invention.

The invention will be explained in detail as follows, referring to the drawings to which, however, the invention is not limited. Meanwhile, in each drawing, an item having the same symbol is assumed to show the same object, and other related drawings are assumed to be consulted properly for detailed explanation.

The structure of the image forming apparatus relating to the invention will be explained, referring to FIG. 1.

Image forming apparatus 20 in the present embodiment of the invention is assumed to be a copying machine of an electrophotographic type.

The numeral 20 represents an image forming apparatus, and 30 represents an automatic document feeder (ADF) installed in the image forming apparatus 20.

With respect to the image forming apparatus 20, manual feeding tray 2 for supplying relatively small amount of transfer sheets P is provided on the right side of casing 1, and sheet-ejection tray 3 is provided on the left side of casing 1.

Transfer sheet P having thereon a formed image supplied from sheet-feeding cassette 12 or from manual feeding tray 2 is ejected on the sheet-ejection tray 3 to be stacked thereon.

Though transfer sheet P includes an ordinary transfer sheet composed of plain paper and a specific transfer sheet composed of an OHP sheet or the like, an ordinary transfer sheet composed of plain paper (which is also called transfer sheet P simply) shall be used, unless otherwise specified.

On the bottom surface of the casing 1, there are provided a plurality of rollers (which are also called casters) 4 which make the image forming apparatus 20 to be movable.

On the upper part on the front side of the casing 1, there is provided control panel CP serving as a display means and an operation input means both for operating the image forming apparatus 20.

Control panel CP includes a liquid crystal display device serving as display means DP, or a liquid crystal display device of a touch panel type in which a touch panel is incorporated in the liquid crystal display device.

As an input device, there is further provided an operation input means composed of key board KB to input numerical values for inputting various image forming conditions including selection of a color of a copy (which is also called a print or printing) such as a color copy or a black and white copy and control related information such as a quantity of copies or a quantity of sets, and of start button (which is also called a copy button) SK to start a series of image forming operations such as copying.

In particular, in the case of display means DP of a touch panel type, input for selection or setting of information shown on a display section can be carried out, if a user touches a pattern such as a button on which a numeral, a character or a symbol shown on a display section is drawn.

For example, the display means DP serves also as an input means for the item that requires selection and setting concerning various operation modes relating to image forming such as a single-sided mode or a two-sided mode.

Incidentally, the single-sided mode means a single-sided copy mode wherein a toner image formed by image forming means 11 based on image data is transferred only onto a single side of transfer sheet P. In this connection, the two-sided mode means a two-sided copy mode wherein an image is formed on each of both sides of a transfer sheet.

Inside the casing 1, there are provided control means EC, transfer separation means 8, fixing unit 10, image forming means 11, image reading means 13, sheet-supply-ejection means 14 and intermediate transfer body 16.

The control means EC is a means which is also called a control circuit and controls all operations of image forming apparatus 20, and it is composed of an electric circuit that is made up of CPU (Central Processing Unit). Based on control programs and control data which are stored in CPU in advance, the control means EC conducts drive control for all means constituting the image forming apparatus 20.

When attachment devices such as ADF 30 and others are connected to the image forming apparatus 20, the control means EC conducts drive control equally, in cooperation with these attachment devices, so that total operations may be carried out smoothly as a system of the image forming apparatus 20.

Further, even when connected to personal computers or other information equipment through LAN (Local Area Network), the control means EC shall be one that can conduct drive control smoothly without any troubles, including storage or delivery and receipt of information necessary for operations, in cooperation with these equipment.

The image forming means 11 is a means to form images based on image information. The present embodiment is called a tandem system wherein image forming unit 11Y that forms yellow (Y) images, image forming unit 11M that forms magenta (M) images, image forming unit 11C that forms cyan (C) images and image forming unit 11K that forms black (K) images are arranged vertically from top to bottom in this order, inside the image forming apparatus 20.

Since image forming units 11Y, 11M, 11C and 11K which constitute the image forming means 11 are the same each other in terms of operations, except that a color of toner to be used is different each other, only image forming unit 11Y that forms yellow (Y) images will be explained in detail, placing symbols.

The image forming units 11Y is composed, for example, of photoreceptor drum (which is also called a photoreceptor) 5Y that is rotated by a drive source such as a motor in the image-forming direction (for example, counterclockwise) established in advance, charging means 6Y that charges the photoreceptor drum 5Y evenly, exposure light EY that is converted to signals based on image information (which is also called image data) and forms an electrostatic latent image on the photoreceptor drum 5Y, developing means 7Y that visualizes the electrostatic latent image formed on the photoreceptor drum 5Y as a toner image, transfer separation means 8Y (which is also called primary transfer means) that transfers the toner image formed on the photoreceptor drum 5Y onto intermediate transfer body 16, and cleaning means 9Y that scrapes off toner and paper dust remaining on the photoreceptor drum 5Y, after the toner image has been transferred onto the intermediate transfer body 16.

Toner images formed by respective image forming units are transferred in succession onto belt-shaped intermediate transfer body 16 (which is also called a transfer belt) rotating clockwise, for example, to be superposed.

Toner images each being in each color transferred onto the intermediate transfer body 16 are transferred onto transfer sheet P from the intermediate transfer body 16 by electrostatic force that is caused by electric charges whose polarity is opposite to that of toner given to transfer sheet P by transfer roller 8 serving as transfer means 8 (transfer section, transfer separation means or simply transfer means).

Transfer sheet P onto which the toner images have been transferred passes through fixing unit 10, and during that period, the toner images are fused and fixed (fixing), thus, transfer sheet P on which a color image is formed by Y, M, C and K toners is ejected on sheet-ejection tray 3 thereafter.

Incidentally, the image forming apparatus employing an intermediate transfer body is widely used for a color image forming apparatus, because toner images formed by respective image forming units can be superposed on an intermediate transfer body. The intermediate transfer body may also be a photoreceptor drum without being limited to a transfer belt, provided that a toner image formed by an image forming unit can be transferred onto the intermediate transfer body. These transfer belt and photoreceptor drum are defied as the image carrying member.

In the present embodiment, transfer separation means 8 is constructed as transfer roller 8 of a contact transfer type, and is arranged at a transfer position facing intermediate transfer body 16, and it is a means to transfer the toner image formed on the intermediate transfer body 16 onto transfer sheet P with electrostatic force by giving electric charges whose polarity is opposite to that of toner to the transfer sheet P.

Meanwhile, each of 8Y, 8M, 8C and 8K (only 8Y is given a symbol) is a transfer separation means used for transferring each of toner images formed respectively by image forming units 11Y, 11M, 11C and 11K onto intermediate transfer body 16 in the same structure.

Cleaning means 9 is one to remove toner and paper dust remaining on the intermediate transfer body 16, and it is composed of a blade and a brush roller. Each of 9Y, 9M, 9C and 9K (only 9Y is given a symbol) is a cleaning means to be used for cleaning a receptor drum of each of image forming units 11Y, 11M, 11C and 11K.

Fixing unit 10 is composed, for example, of a heat roller having therein a heater and a pressure roller, which is not illustrated, and it is a means to fuse and fix (fixing) toner images transferred onto transfer sheet P with heat (for example, approx. 200° C.) and pressure.

Image reading means 13 is composed of a reading optical system having therein light source LT, mirror group MR and image forming lens LZ and of reading device ES having therein an electric circuit including CCD (solid-state image sensor).

The reading device ES reads image information on a document placed on a platen glass (not shown) provided on an upper part of casing 1 and on a document which has been conveyed to a reading position by automatic document feeder 30, then, converts them into digital image data, and stores the image data in a storage means provided on control means EC.

When reading a document conveyed by ADF 30 with image reading means 13, the document conveyed to the reading position is irradiated by light source LT, then, reflected light from the document is focused by image-forming lens LZ on a CCD surface of the reading device ES through mirror group MR, whereby, image information outputted by CCD is stored as image data.

The sheet-supply-ejection means 14 is constituted as a sheet-supply-ejection conveyance device (a transfer sheet conveyance means) composed of sheet-supply cassette 12, a motor as a driving source and a plurality of rollers.

The sheet-supply cassette 12 is composed of, for example, cassette 12*a* housing therein a specific transfer sheet and cassette 12*b* housing therein plain paper.

After the specific transfer sheet or plain paper is selected by instructions of control means EC, the sheet-supply-ejection conveyance device serving as the sheet-supply-ejection means 14 supplies and conveys the selected sheet or paper toward intermediate transfer body 16 from the sheet-feeding cassette 12, by rotating a motor representing a driving source and thereby, by driving a plurality of rollers to rotate, thus, a toner image is fused and fixed (fixing) in fixing unit 10, and an image is formed, whereby the sheet or paper is conveyed to be ejected to sheet-ejection tray 3. The sheet-supply-ejection conveyance device has a roller R2 (registration roller) to convey a transfer sheet to a transfer roller 8 by mating timing with the movement of a toner image being carried by the intermediate transfer body 16, and this roller R2 constructs a transfer attitude correcting section according to the present invention.

The intermediate transfer body 16 is also called a transfer belt, and it is composed of a belt-shaped one trained about plural rollers which is rotated clockwise by a driving source such as an unillustrated motor in the present embodiment.

When using an intermediate transfer body, it is preferable to select and use proper ones for electric characteristics (specific volume resistance, surface resistivity), thickness, structure (for example, a layer number such as a single layer, two layers or three layers), material and quality of material, depending on image forming conditions.

The whole conveyance device of ADF 30 is covered by ADF casing 31, and document placing stand 32 and sheet-ejection section 33 are provided outside the ADF casing 31.

On the document placing stand 32, there are placed plural documents WP each being in the state where the document surface on page one (the face) is uppermost. The documents WP placed is conveyed to the reading position by the document conveyance device composed of a plurality of rollers, then, is read by reading device ES to be ejected to sheet-ejection section 33.

The document conveyance device interlocks with control means EC to operated through an unillustrated drive control circuit.

Image forming operations in the present embodiment will be explained briefly here.

In the case of a single-sided mode wherein an image is formed on one side of transfer sheet P, yellow (Y) toner image is formed through operations of well-known image forming unit 11Y of an electrostatic photography system based on image data obtained through reading by image reading means 13 shown in FIG. 1, or image data stored in a memory of control circuit EC described later through a communication network such as LAN, and the toner image is transferred onto intermediate transfer body 16.

In the same way, a magenta (M) toner image, a cyan (C) toner image and a black (K) toner image are formed respectively by image forming units 11M, 11C and 11K, and are transferred onto intermediate transfer body 16.

On the other hand, with respect to one sheet of transfer sheet P taken out of sheet-feeding cassette 12, its leading edge is caused by sheet-supply-ejection means 14 to hit roller R2 from the direction X1 to form a loop, and stops temporarily at a position of the roller R2 provided in the conveyance path in the vicinity of the intermediate transfer body 16. Thus, a skew of the transfer sheet is preliminarily corrected, and further, the skew of the transfer sheet and the transfer position is finally precisely corrected by a transfer attitude correcting section mentioned later. Thereafter, the transfer sheet P is conveyed toward the intermediate transfer body 16 by the roller R2, at proper timing.

When the transfer sheet P approaches intermediate transfer body 16, transfer roller 8 operates in the direction to touch the intermediate transfer body 16, and after that, when the transfer sheet P passes a transfer position where the intermediate transfer body 16 faces the transfer roller 8 while the transfer sheet P is interposed between the intermediate transfer body 16 and the transfer roller 8, electric charges whose polarity is opposite to that of toner images are given to the transfer sheet, and electrostatic force of the electric charges transfers toner images on the intermediate transfer body 16 onto the second surface (the surface) of the transfer sheet P.

The transfer sheet P on which toner images have been transferred passes through fixing unit 10 in which the toner images are fused and fixed, and then, it is conveyed in the direction X4 to be ejected to sheet-ejection tray 3. When forming images on one side of each of plural transfer sheets P, the aforesaid operations are repeated for practice.

Further, when conducting two-sided copying (two-sided mode), control means EC first causes operations to form an image on one side of the transfer sheet P to be carried out.

The transfer sheet P in which an image is formed on only one side of the transfer sheet is conveyed toward sheet-ejection tray 3 (direction of arrow X4) after it passes through fixing unit 10, and the control means EC stops rotation of roller HR immediately before the trailing edge of the transfer sheet P passes through paired rollers HR.

Successively, the transfer sheet is conveyed in the direction X3 by rotating roller HR to the opposite direction, to reverse the transfer sheet in terms of its front side and the other side, and it is conveyed to conveyance path WA through conveyance paths C and D.

The transfer sheet P which has entered the conveyance path WA again is stopped at a position of the roller R2 temporarily in the same way as in the case of a single-sided mode to form an image on one side, and is conveyed in the direction of the intermediate transfer body 16 at proper timing.

With respect to the transfer sheet conveyed in the direction of the intermediate transfer body 16, a toner image formed on the first surface (reverse side) by the image forming means 11 is transferred onto transfer sheet P from the intermediate transfer body 16 by transfer roller 8, in the same way as in a single-sided copying.

Then, after passing through fixing unit 10, the transfer sheet P is conveyed in the direction of X4 toward sheet-ejection tray 3 to be ejected, without stopping of roller HR this time, thus, two-sided copying on one transfer sheet P is completed. Accordingly, this process is repeated when conducting two-sided copying on a plurality of sheets.

Incidentally, a method to eject a transfer sheet in a single-sided mode includes a face-up sheet ejection to eject a sheet with its printed surface facing upward (face side) and a face-down sheet ejection to eject a sheet with its printed surface facing downward (reverse side), and conveyance path WB is one for conducting face-down sheet ejection.

Though a guide member to convey a transfer sheet properly and a switching means to switch a conveyance path are generally provided in many cases, illustrations and explanation concerning these members are omitted here to simplify explanation in the present embodiment of the invention.

The transfer attitude correction section relating to the invention will be explained as follows, referring to FIG. 2.

Figure 2:
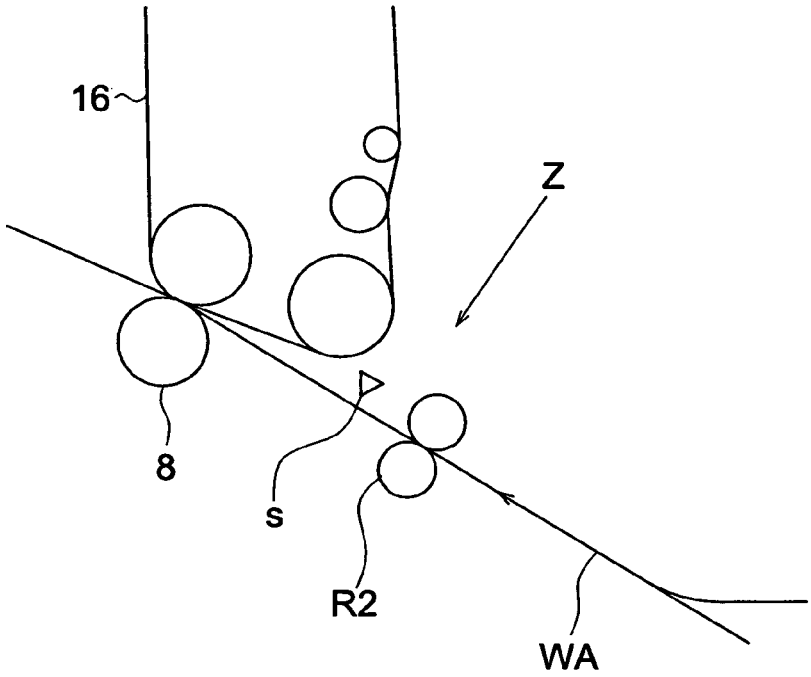
FIG. 2 is a view showing a frame format of a transfer attitude correcting section relating to the invention.
Figure 2:
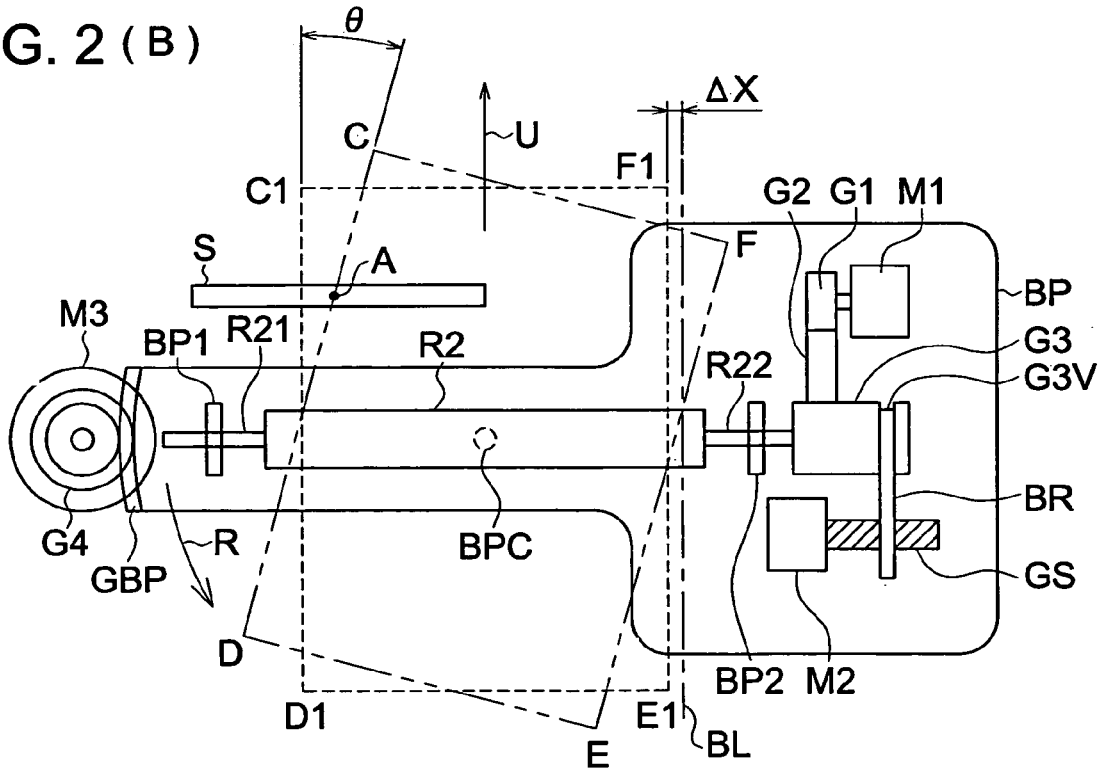

FIG. 2 (A) is a partially enlarged diagram of a periphery of a conveyance path covering from roller R2 to roller 8 in FIG. 1. FIG. 2 (B) is a schematic diagram of a transfer attitude correcting section which is viewed from the direction of arrow Z in FIG. 2 (A). Incidentally, those having the same symbols as those in FIG. 1 are to be the same members.

In FIG. 2 (B), BP represents a base board to construct a roller unit of the transfer attitude correcting section. On base board BP, there are provided bearings BP1 and BP2, and bearing BP1 is engaged with slightly longer shaft R21 wherein an amount of movement of the transfer sheet is considered so that the transfer sheet can be moved in the direction perpendicular to the direction for conveyance of the transfer sheet, and bearing BP2 is engaged with slightly longer shaft R22 on which gear G3 is fixed and an amount of movement is taken into consideration.

Further, on the base board BP, there is provided motor M1 that gives driving force for conveying a transfer sheet in the conveyance direction while interposing the transfer sheet. Gear G1 that is fixed on the motor M1 engages with gear G3 through intermediate gear G2 to rotate roller R2.

Incidentally, the roller R2 is composed to be a pair of rollers as shown in FIG. 2 (A), and although the mechanism for rotating the paired rollers for conveying a transfer sheet can be constructed simply by using a rotation transmission mechanism such as a known gear mechanism and a belt mechanism, an illustration is omitted for the structure as the paired rollers, for simplifying the explanation.

The symbol M2 represents a motor for moving the roller R2 in the direction perpendicular to the conveyance direction of a transfer sheet, and on the motor M2, there is provided screw gear GS which is connected with gear G3 provided on shaft R 22 of roller R2 by connection plate BR.

One end of the connection plate BR is engaged with groove portion G3V provided on gear G3, and the other end thereof is engaged with screw gear GS, and when the motor M2 rotates, the roller R2 can be moved straight toward the left side or the right side, depending on the rotation direction of the motor M2.

Further, since gear GBP is provided partially on the left end portion of the base board BP and gear GBP is engaged with gear G4 rotated by motor M3, the roller R2 can be swung together with the base board BP clockwise or counterclockwise on the rotation center BPC, depending on the rotation direction of the motor M3 so as to correct a skew of a transfer sheet.

Meanwhile, the expression of functioning the base board BP on the same plane clockwise or counterclockwise on the rotation center BPC for correcting the skew is especially assumed to be the expression of swinging, which equally applies to the explanation hereafter.

The symbol S represents a position measurement means, and for example, it is a sensor (line sensor) wherein plural fine image sensors are provided straight in the direction perpendicular to the conveyance direction for transfer sheets.

Now, operations for correcting skew of transfer sheets will be explained briefly. For example, a transfer sheet is conveyed from a sheet-supply cassette 12 by the sheet-supply-ejection means 14 toward a roller R2 which is stopped. Then, when a leading edge of the transfer sheet arrives the stopped roller R2, the leading edge of the transfer sheet hits the roller R2 temporarily and forms a loop so that a large skew can be corrected.

Successively, if the roller R2 rotates and thereby the transfer sheet is conveyed at proper timing toward transfer roller 8, and when a part of the transfer sheet has passed through the roller R2, the sensor S measures either one side end portion of the part of the transfer sheet whose orientation is along the conveyance direction of the transfer sheet, namely, the first position of point A on the left side of the transfer sheet in FIG. 2 (B) and the second position of point B after prescribed time interval t (sec.), thus, positional information of point A and point B is obtained including conveyance speed V, and angle θ of the skew is calculated.

Then, when the transfer sheet is a tetragon shown by two-dot chain lines connecting points C, D, E and F as shown in FIG. 2 (B), if the transfer sheet is calculated to oblique (to be skewed) by degree θ, the motor M3 is operated to swing the base board BP together with the roller R2 counterclockwise on the rotation center BPC by θ degree while the roller R2 is interposing the transfer sheet, so that the transfer sheet may be corrected to become a tetragon shown by broken lines connecting points four points of C1, D1, E1 and F1.

In this case, when skew is corrected by rotating the roller unit by θ degree on the rotation center BPC from the positional information obtained by measurement of two points A and B by the sensor S, if the transfer position of the transfer sheet is deviated, after calculating amount of deviation ΔX by which a straight line connecting F1 and E1 is deviated from a transfer reference position BL predetermined in advance, in the direction perpendicular to the conveyance direction, the motor M2 is rotated based on the amount of deviation to shift the roller R2 on the base board BP so that the transfer position of the transfer sheet can be corrected on the roller unit.

Next, a method of calculating an amount of skew of a transfer sheet will be explained, referring to FIG. 3.

Figure 3:
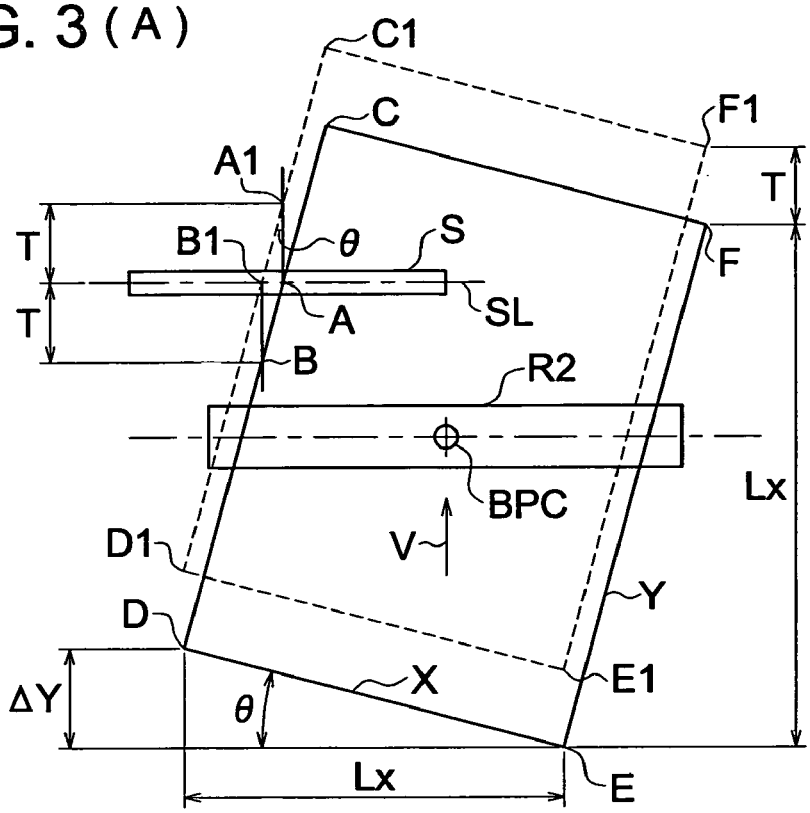
FIG. 3 is an illustration for explaining the transfer sheet skew correction relating to the invention.
Figure 3:
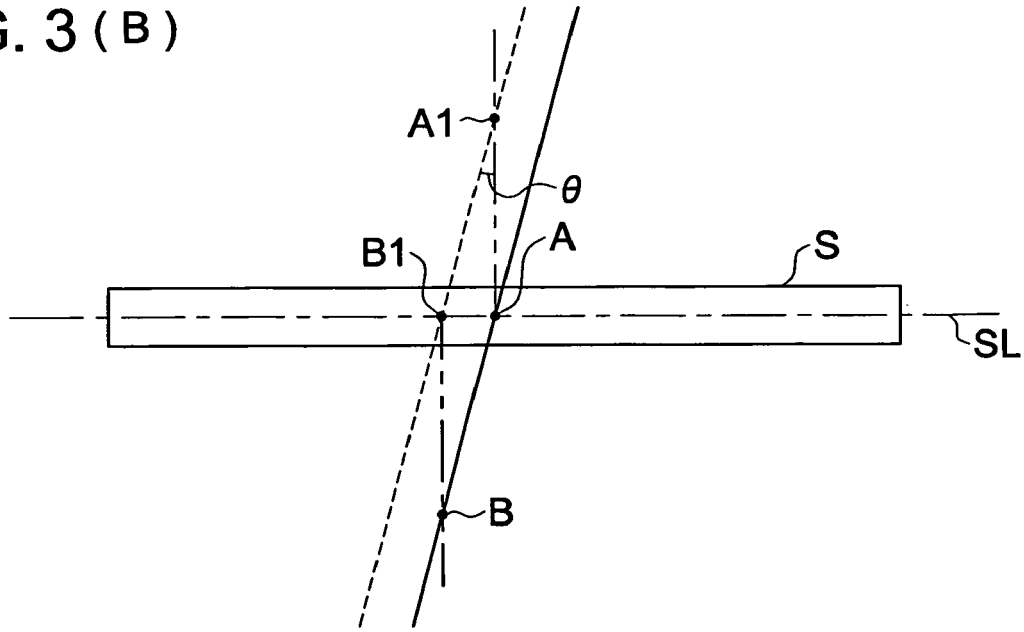

FIG. 3 (A) shows a method of calculating amount ΔY of skew of a transfer sheet conducted by sensor S, while, FIG. 3 (B) shows relationship between first position of point A representing a measurement point on the sensor S and on the left end portion (solid line) of a transfer sheet and second position of point B representing a measurement point on the left end portion (broken line) after prescribed time interval t (sec.).

In other words, FIG. 3 (B) shows that point A measured by the sensor S advances to position A1 after Δt sec after the measurement was started. of the conveyance of the transfer sheet, and point B positioned at the rear of the sensor arrives at position B1 after Δt sec. to be measured by the sensor S. Incidentally, SL shown with a one-dot chain line represents a line of a measurement reference position that is assumed to show the measurement reference position in the case of measuring two points of point A and point B by the sensor S.

In FIG. 3 (A), let it be assumed that a quadrangular transfer sheet shown with solid lines connecting C, D, E and F has been conveyed to the position of a quadrangular transfer sheet shown with broken lines connecting C1, D1, E1 and F1, after Δt sec. Then, let it be assumed that the transfer sheet measuring Y×X in length and width is conveyed, under the condition that segments DE and CF are equally set to dimension X, while, segments CD and EF are equally set to dimension Y.

When a transfer sheet is conveyed at conveyance speed V, if the point A is measured on the measurement reference position SL of the sensor S and point B is measured after Δt sec., for example, as shown in FIG. 3 (B), distance T for point A to move to point A1 and distance T for point B to move to point B1 are obtained by $T=V\times\Delta t$.

Further, a distance between point A and point B (point B1) on the measurement reference position SL of the sensor S is obtained, for example, as a distance between a detection position of point A and that of point B in plural image sensors constituting the sensor S, and it becomes $|A-B|$.

Therefore, skew angle θ of the transfer sheet can be obtained by $\theta=\tan^{-1}(|A-B|/(V\times\Delta t))$.

In this case, when Ly represents a length in the conveyance direction in the case where the transfer sheet measuring Y×X in length and width is skewed by skew angle θ, and Lx represents a length in the direction perpendicular to the conveyance direction, amount of skew in the conveyance direction ΔY is expressed by $\Delta Y=Lx\times\tan\theta$.

Further, the amount of skew in the conveyance direction can also be obtained from $\Delta Y=X\times\sin\theta$, because of $Lx=X\times\cos\theta$.

Further, by judging which side of the point A the point B locates, that is, the right side or the left side on the basis of the position of a image sensor detecting the point B among plural image sensors that, the orientation of the skew is judged as a rightward skew or a leftward skew.

In the present embodiment, therefore, motor M3 is rotated by the transfer attitude correcting section shown in FIG. 2 (B) by an amount equivalent to the obtained skew angle θ or amount of skew ΔY in a direction to correct the judged orientation of the skew, so as to swing the base board BP in the counterclockwise direction for the skew of the transfer sheet shown in FIG. 3, whereby, the skew is corrected under the circumstance that the transfer sheet is interposed by roller R2 on the base board BP.

Incidentally, in the present embodiment, if right side edge portion DF is deviated from transfer reference position BL by ΔX as shown in FIG. 2 (B) when the base board BP is swung counterclockwise, amount of deviation ΔX from the transfer reference position BL is calculated equally by calculating the position after correction of corner portions (C, D, E and F) of the transfer sheet for the rotation center, and motor M2 is rotated based on the calculated amount ΔX to move the roller R2 in the direction perpendicular to the conveyance direction, thereby, the amount of deviation ΔX from the transfer reference position BL can be corrected on the condition that the transfer sheet is interposed by roller R2 on the roller unit.

Further, sensor S detects whether a leading edge of the transfer sheet has passed through measurement reference position SL or not, and when its passage is detected, a timer (not shown) of control circuit EC is operated, and timer counter Ta wherein measurement start timing to for measuring two points on the edge of the transfer sheet and elapsed time for measurement time interval Δt for the two points are calculation values, is operated, or timer counter Tb wherein elapsed time for preset time t2 for a leasing edge of the transfer sheet to cover a period from passing through measurement reference position SL of sensor S up to arrival at a transfer position of the transfer roller is a calculation value, is operated.

Therefore, control circuit EC in the present embodiment operates a timer after a leading edge of the transfer sheet passes through the measurement reference position SL of sensor S, whereby, the first point on the transfer sheet is measured after a period of t0 in terms of elapsed time ta by timer counter Ta, and the second point is measured after a period of Δt from the period of t0, and the skew of the transfer sheet based on the measurement results is corrected.

On the other hand, elapsed time tb required for the transfer sheet to be moved to the transfer position of transfer roller 8 by timer counter Tb is counted, and when time t2 established in advance is not exceeded, the leading edge of the transfer sheet is judged not to arrive at the transfer position of the transfer roller, so that correction of skew of the transfer sheet may be repeated.

In the present embodiment, point A measured by sensor S advances to position A1 after Δt sec. as the transfer sheet is conveyed, while, point B positioned behind the sensor S arrives at position B1 after Δt sec., as shown in FIG. 3 (B), and both points are measured by the sensor S. In an image forming apparatus, there is sometimes an occasion, for example, wherein plural speeds for conveying transfer sheets are provided corresponding to sizes of transfer sheets.

Though a time interval between point A and point B is set to be Δt sec. when measuring a position, in the present embodiment, if the conveyance speed varies depending on the size of a transfer sheet, an actual distance interval between point A and point B varies for each transfer sheet size. If the distance varies for each transfer sheet size like this, detection accuracy of the sensor S is sometimes varied depending, for example, on the arrangement of plural fine image sensors in the direction perpendicular to the conveyance direction for the transfer sheet. When the conveyance speed varies depending on the transfer sheet size, therefore, it is preferable to make the distance interval between point A and point B to be constant, and thereby to make the detection accuracy to remain unchanged.

In the present embodiment, therefore, in order to keep the distance interval between point A and point B to be constant even when the conveyance speed varies, data of time interval Δt for plural conveyance speeds are stored in a storage means, and when changing the conveyance speed, time interval Δt for the conveyance speed to be changed is read out to control measurement timing in control circuit EC.

If the size of a transfer sheet is changed, positions of point A and point B on the side of the transfer sheet A to be detected by sensor S on the side portion of the transfer sheet shown in FIG. 3 (B) are changed. It is therefore necessary to lengthen a length of an image sensor of the sensor S for measuring point A and point B in the direction perpendicular to the conveyance direction for the transfer sheet, to cover a range from a small-sized transfer sheet to a large-sized transfer sheet. When the conveyance speed is low, in particular, it is necessary to lengthen more, if the time t0 to start the measurement for the point A after the leading end of a transfer sheet has passed the measurement reference position is set to be constant. Since the sensor S is composed of plural microscopic image sensors, if a length of the sensor S is increased, image sensors equivalent in terms of quantity to the increase of the length are needed, which results in cost increase in general.

Therefore, even when a size of the transfer sheet is changed, the time t0 to start measuring the point A is changed so that a length of a detection section (position measurement section) composed of image sensors in the sensor S may be as short as possible. In other words, data of time t0 corresponding to plural transfer sheet sizes are stored in a storage means, and when changing a transfer sheet size, the time t0 corresponding to transfer sheet size to be changed is read out to control measurement timing, so that measurement may be carried out by a position measurement section having a prescribed length.

Incidentally, although the explanation has been given under the condition of measurement positions of two points of point A and point B in the present embodiment, it is also possible to measure two or more measurement positions for enhancing measurement accuracy, taking, for example, deformation of the transfer sheet into consideration.

Figure 4:
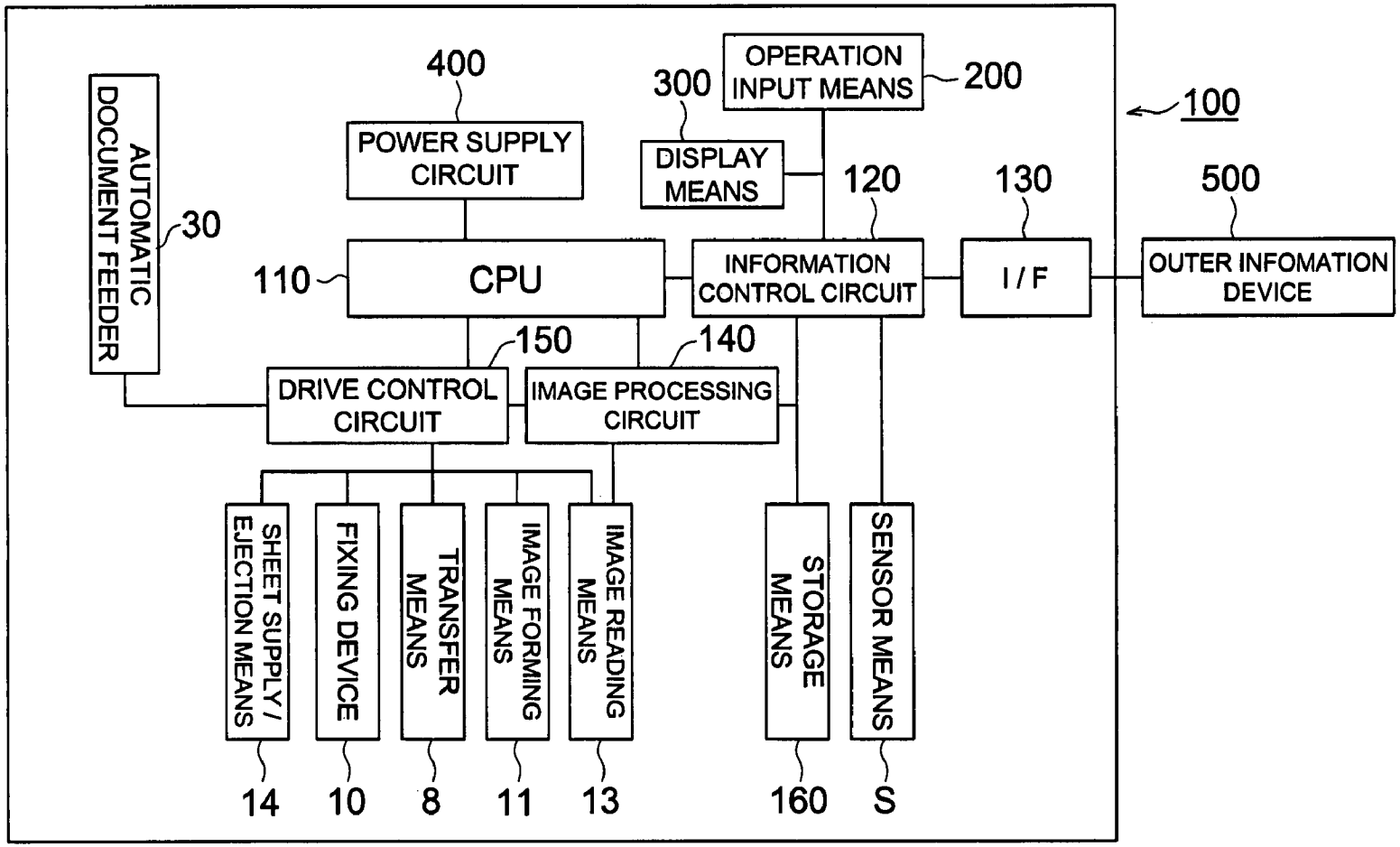
FIG. 4 is a block diagram showing circuit structures of an image forming apparatus relating to the invention.

Now, the circuitry of an image forming apparatus relating to the invention will be explained as follows, referring to FIG. 4. In the present embodiment, an explanation will be given for an occasion wherein an image forming apparatus is a copying machine as mentioned above.

The numeral 100 represents a structure of various means of the whole of image forming apparatus 20 and circuits. The numeral 110 represents CPU that conducts control of the total image forming apparatus, and programs of various modes for controlling image forming apparatus 20 and data necessary for practicing the programs are stored in CPU in advance.

Information control circuit 120, image processing circuit 140, drive control circuit 150 and power supply circuit 400 are connected to CPU 110. Control means EC shown in FIG. 1 is composed of the aforesaid circuits, which makes it possible to control the whole of the image forming apparatus 20.

Information control circuit 120 is connected with outer information device 500 through interface (I/F) 130 in accordance with instructions of CPU 110, and inputs image information such as characters and images as well as information to be established such as density and magnification necessary for image-forming, to store them in storage means 160. Then, information to be established stored in storage means 160 are outputted to image processing circuit 140, drive control circuit 150 or to display means 300.

Information control circuit 120 has a function to judge various pieces of information inputted by operation input means 200, for example, relating to instruction information necessary for operations of circuits including image processing circuit 140 and drive control circuit 150 and various means and information showing operation conditions outputted from respective means of an apparatus during their operations in addition to JOB information composed of image information and established information inputted from outer information device 500 through an information network, and to transmit the information [to respective circuits and means of the image forming apparatus smoothly and properly, so that the image forming apparatus may not have troubles in its operations.

Incidentally, the outer information device 500 is mainly a computer and a Internet server which are connected through the information network. However, under some circumstances, it is supposed to be another image forming apparatus connected to a local area network (LAN), or an information device such as a digital camera or a measuring device capable of outputting measured information.

In the present embodiment, information control circuit 120 calculates skew angle θ and amount of skew ΔY of a transfer sheet based on position information for two points on the transfer sheet which are obtained through measurement by sensor S representing a sensor mean, and judges whether the transfer sheet is skewed or not based on the calculated results, for correcting a skew of a transfer sheet. Further, the amount of deviation ΔX of the transfer position a transfer sheet from the transfer reference position BL is calculated on the basis of the positional information of two points of the transfer sheet. Then, drive control circuit 150 which will be described later operates the transfer attitude correction section having the roller R2 based on skew angle θ, amount of skew ΔY and the amount of deviation ΔX calculated by the information control circuit 120, to correct the skew and the deviation of the transfer sheet.

For example, when a leading edge of the transfer sheet is detected by sensor S, a timer (not shown) is activated to operate timer counters Ta and Tb. Then, the timer counter Ta counts first measurement time t0 and elapsed time ta that is for synchronizing the measurement by sensor means S with time interval t from the first measurement time t0.

For the purpose of correcting the transfer attitude of a transfer sheet repeatedly until the transfer sheet arrives at a transfer position of transfer roller 8, there is provided a function wherein time t2 during which a leading edge of the transfer sheet is estimated to arrive at the transfer position on the transfer roller 8 is calculated, taking operations for correction of the transfer attitude of the transfer sheet into consideration, and timer counter Tb counts elapsed time tb for the time t2 established in advance to judge whether the transfer attitude of the transfer sheet should be corrected or not.

There is further provided a function wherein, when the conveyance speed of an image forming apparatus and a transfer sheet size of a transfer sheet to be used are changed, time interval Δt stored in storage means 160, namely, time interval Δt between point A and point B in the case of measurement of positions by sensor S is read to control measurement timing.

Interface (I/F) 130 is an information sending and receiving means, and it is constructed to be connected with the aforesaid outer information device 500 such as the computer, other image forming apparatuses and Internet server, through various types of networks.

Operation input means 200 is an input device provided on control panel CP of image forming apparatus 20, and the input device is supposed to be the aforesaid liquid crystal display device DP representing a display means of a touch panel type, key board KB and start button SK.

For example, the input device is structured so that establishment information such as output quantity and types of transfer sheets (for example, index paper, thick paper, plain paper, thin paper, recycled paper and OHP sheet), or magnification including enlargement and reduction and density of outputted images can be inputted by operating key board KB.

Under some circumstances, the operation input means 200 serves also as an input means for setting various operation modes for image forming apparatus 20 such as, for example, a color mode, a black and white mode, or a single-sided mode and a two-sided mode which are selected and established in the case of conducting copy operations.

In particular, the present embodiment is arranged so that a transfer attitude correction mode for a transfer sheet can be selected and established by operating liquid crystal display device DP of a touch panel type provided on control panel CP of operation input means 200.

For example, when a mode change is selected on an initial menu screen, and a transfer attitude correction mode for a transfer sheet is selected, a correction condition setting button appears on liquid crystal display device DP. Then the correction condition setting button is required to be touched and pressed by a finger to display a correction menu screen displaying correction conditions. If repeated corrections are needed, a repeating correction button displayed on a correction menu screen is pressed to select a repeating correction mode, and if a completion button is pressed after completion of selection and establishment, the establishment is completed, and the screen returns to the initial menu screen. Incidentally, if correction conditions are neither selected nor established newly even when the correction menu screen is displayed, the completion button can be pressed, which equally returns the screen to the initial menu screen.

Display means 300 is composed of the aforesaid liquid crystal display device or of display device DP wherein a touch panel is incorporated in a liquid crystal display section.

On the display means 300, there are displayed a table of operation procedures for inputting information with operation input means 200 and of various pieces of information (which is called also a menu), a display of information stored in storage means 160, a display of condition in operations of image forming apparatus 20 and an alarm display.

Image processing circuit 140 is a circuit that compresses or extends, for example, image information of a document obtained through reading by image reading means 13 in collaboration with information control circuit 120 under the instruction of CPU 110 and image information inputted in the image forming apparatus through the information network, to store them in storage means 160 as image data, and converts the image data into data or signals suitable for an image forming system of image forming means 11 when the image forming means 11 forms an image based on image data stored in storage means 160.

Drive control circuit 150 is a circuit that activates transfer means 8, fixing unit 10, image forming means 11, image reading means 13, sheet-supply-ejection means 14 and ADF 30, on proper timing based on an operation mode established in advance, to act image forming operations.

In particular, in the present embodiment, motors M1, M2 and M3 each constituting the transfer attitude correcting section are activated properly by a correction operation program established in advance, based on a skew angle θ, an amount of skew ΔY and an amount of deviation ΔX of the transfer sheet calculated by information control circuit 120 under the instruction of CPU 110, thereby, the base board BP together with the roller R2 is swung on the rotation center BPC and the roller R2 is shifted on the base board BP, as a result, the skew of the transfer sheet and the deviation of the transfer sheet can be corrected.

As stated above, sensor S is constructed with plural fine image sensors provided straight in the direction of the shaft of roller R2 perpendicular to the conveyance direction for the transfer sheet, and it is one to measure the first position (point A) on the side edge on one side of the transfer sheet being in parallel with the conveyance direction for the transfer sheet thus conveyed, on measurement reference position SL of sensor S and to measure the second position (point B) at prescribed time interval Δt, to conduct correction of the skew of a transfer sheet relating to the invention. Meanwhile, the positional information for the two points measured by the sensor S is stored in storage means 160 by the instructions of information control circuit 120.

The storage means 160 stores JOB information composed of image data necessary for forming images and establishment conditions for controlling image forming apparatus 20 and information such as JOB data relating to JOB information and programs for various establishment modes.

In the present embodiment, the storage means 160 stores positional information for two points obtained through measurement by sensor S, information of the skew angle θ, the amount of skew ΔY and the amount of deviation ΔX for the transfer sheet calculated by information control circuit 120, or a calculation expression and data such as motor driving time and driving timing for operating properly motors M1, M2 and M3 constituting the transfer attitude correcting section shown in FIG. 2 corresponding to the amount of skew ΔY and the amount of deviation ΔX for the transfer sheet.

In the storage means 160, there is stored time interval Δt between point A and point B and a time t0 to start measuring the point A in the occasion where the sensor S measures based on plural conveyance speeds of an image forming apparatus and on plural transfer sheet sizes to be used.

Therefore, the information control circuit 120 measures two points with sensor S shown in FIG. 2 provided on sheet-supply-ejection means 14, based on these calculation expression and data, and calculates an amount of skew of the transfer sheet and an amount of deviation of a transfer position of the transfer sheet based on the results of the measurement. On the other hand, based on the amount of skew of the transfer sheet and the amount of deviation of the transfer position of the transfer sheet, the drive control circuit 150 swings the base board BP together with the roller R2 of the transfer attitude correcting section on rotation center BPC to correct the skew of a transfer sheet and shifts the roller 2 in its axial direction on the base board BP to correct the deviation of the transfer position, thereby correcting the transfer attitude.

In the present embodiment, when the sensor S measures repeatedly for correcting the transfer attitude of the transfer sheet repeatedly, positional information for two points measured repeatedly and information such as a skew angle θ, an amount of skew ΔY and a deviation ΔX of a transfer position of the transfer sheet calculated by information control circuit 120 based on the results of measurement are all stored in the storage means 160 until completion of a series of JOB.

In the case of power supply circuit 400, when a power supply switch (not shown) is turned on by a user, the whole of an image forming apparatus is energized properly by the power supply, and when the power supply switch is turned off, the energization is cut.

Incidentally, the power supply circuit 400 is further arranged so that, even when the power supply switch is turned on (ON), the power supply circuit can continue only energization necessary for preservation of contents of temporary memory and cut other energization such as that for the heater of a fixing unit, for the image forming apparatus, under the instructions of CPU 110, when a power-saving mode that makes the image forming apparatus to be in the standby state is selected.

Further, it is also possible to arrange so that, even when power is cut (OFF) by the power supply switch, the power supply circuit 400 does not cut power entirely, but conducts energization necessary for CPU 110 to operate so that image forming operations may be started quickly, responding to the occasion where the power supply switch is turned on (ON), or, image information is inputted through LAN, like the occasion of a power-saving mode that makes the image forming apparatus to be in the standby state.

Figure 5:
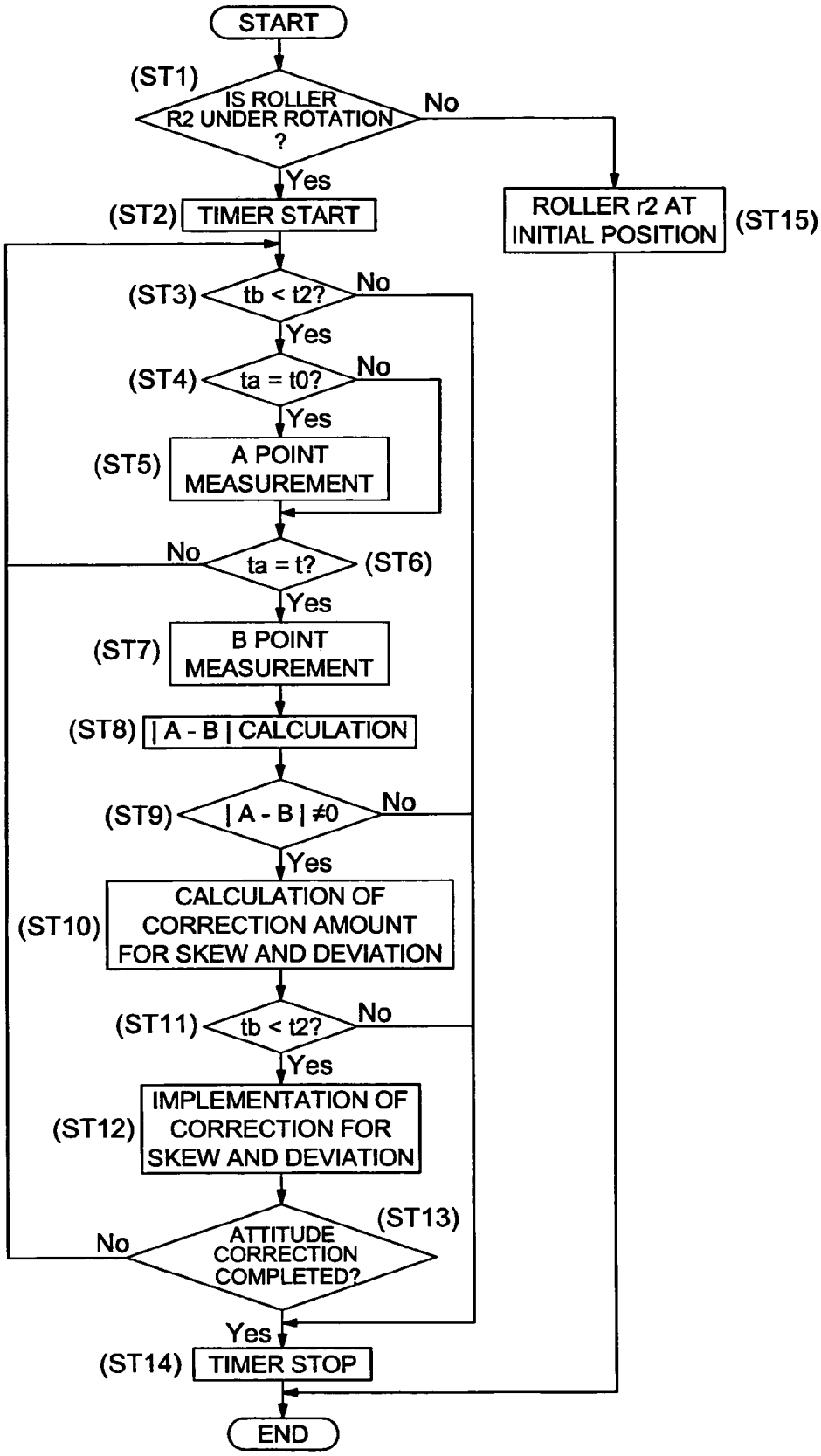
FIG. 5 is a flow chart showing control procedures for transfer skew correction relating to the invention.

Next, a procedure of correcting the transfer attitude will be explained as follows, referring to a flow chart shown in FIG. 5. For simplifying the explanation, the image forming apparatus is made to be a copying machine, as a prior condition. Further, the conveyance speed and a transfer sheet are not changed, and time interval Δt in the case of measuring two points with sensor S is made to be constant.

This control procedure is just an example of control based on the present embodiment, and the invention is not limited to this procedure.

(ST1)

This is a step to judge whether roller R2 is rotating or not. In other words, the transfer attitude correction in the present embodiment is conducted on the transfer sheet in the conveyance path covering from roller R2 to transfer roller 8. Therefore, when the roller R2 is not rotating, it shows state where the transfer sheet is not conveyed by the roller R2, thus, the operations to correct the transfer attitude are not conducted in that case.

Therefore, when the roller R2 is judged to be rotating, a step advances to ST2, while, when the roller R2 is judged not to be rotating, a step advances to ST15.

Incidentally, an arrangement is made so that whether roller R2 is rotating or not can be judged, for example, by information control circuit 120 that detects whether the signal to control operations of motor M1 shown in FIG. 2 (B) is in the state of outputted from drive control circuit 150 to the transfer attitude correcting section of sheet-supply means 14.

(ST2)

This is a step to start a timer of control circuit EC. In other words, a transfer sheet is conveyed by rotating roller R2 toward transfer roller 8, and if a leading edge of the transfer sheet is detected by sensor S, for example, the information control circuit 120 operates a timer, and a step advances to ST3.

In the present embodiment, when the timer operates, there are operated timer counter Ta that counts time for controlling timing of measurement by sensor S and timer counter Tb that counts time for judging whether a leading edge of the transfer sheet has arrived at the transfer position on the transfer roller 8 or not.

(ST3)

This is a step to judge whether tb is smaller than t2 or not. Namely, this is a step to judge whether a leading edge of the transfer sheet has arrived at the transfer position of the transfer roller.

The symbol t2 represents a period of time wherein time from the moment when a leading edge of the transfer sheet is detected by sensor S up to the moment when the leading edge of the transfer sheet arrives at the transfer position on the transfer roller 8 is established by considering the conveyance speed for the transfer sheet and time of correction operations in advance.

The symbol tb represents the time elapsed as a counted value by timer counter Tb that starts operations when a leading edge of the transfer sheet is detected by sensor S.

The information control circuit 120 compares tb with t2 to detecting whether a leading edge of the transfer sheet has arrived at the transfer position of the transfer roller 8.

Therefore, when tb is smaller than t2, the leading edge of the transfer sheet is judged not to have arrived at the transfer position of the transfer roller 8, and a step advances to ST4 for conducting correction of the transfer sheet skew, while, when tb is greater than or equal to t2, the leading edge of the transfer sheet is judged to have arrived at the transfer position of the transfer roller 8, and a step advances to ST14 without correcting the skew of the transfer sheet.

(ST4)

This is a step to judge whether ta is equal to t0 or not. Namely, for controlling timing of measurement by the sensor S, when the time elapsed ta representing a value counted by timer counter Ta is equal to t0, the information control circuit 120 measures the first measurement point (point A) with sensor S.

Therefore, when ta is not equal to t0, namely, when ta is less than to and when ta exceeds to, a step advances to ST6, and only when ta is equal to t0, a step advances to ST5 so that the first measurement point (point A) may be measured by sensor S.

(ST5)

This is a step to measure point A (first measurement point). After the first measurement point (point A) of the transfer sheet shown in FIG. 3 is measured by sensor S, the measured values are stored in storage means 160, and a step advances to ST6.

(ST6)

This is a step to judge whether ta is equal to Δt or not. Accordingly, when ta is not equal to Δt, namely, when ta is less than Δt and when ta exceeds Δt, a step advances to ST3, and only when ta is equal to Δt, a step advances to ST7 so that the second measurement point (point B) may be measured by sensor S.

However, if a step advances to ST7 to measure the second measurement point (point B) when ta is equal to Δt, ta is reset in terms of its counted value at, for example, ST13 thereafter. Therefore, ta does not exceed Δt actually.

(ST7)

This is a step to measure point B (second measurement point). After the second measurement point (point B) of the transfer sheet shown in FIG. 3 is measured by sensor S, the measured values are stored in storage means 160, and a step advances to ST8.

(ST8)

This is a step to calculate |A−B|. After positional information (which is also called position data) of point A (first measurement point) and point B (second measurement point) stored in storage means 160 are read out, and a difference of position data between two points is obtained, a step advances to ST9.

(ST9)

This is a step to judge whether |A−B| is different from 0 or not. Namely, when |A−B| is equal to 0, two points agree with each other, which shows that the transfer sheet is not skewed, and a step advances to ST14 without conducting correction of transfer sheet skew, while, when |A−B| is not 0, skew of the transfer sheet is indicated, and a step advances to ST10 to correct the skew of the transfer sheet.

(ST10)

This is a step to calculate an amount of skew correction and an amount of deviation correction. Namely, skew angle θ, amount of skew ΔY and amount of deviation ΔX of the transfer sheet are calculated from position data of two points as shown in FIG. 3, and a step advances to ST11. In addition, by judging which side of the point A the point B locates, that is, the right side or the left side, the orientation of the skew is judged as a rightward skew or a leftward skew at this step.

(ST11)

This is a step to judge whether tb is smaller than t2 or not. Namely, it is a step to judge whether a leading edge of the transfer sheet has arrived at the transfer position of the transfer roller or not, in the same way as in ST3.

Namely, when tb is greater than or equal to t2, the leading edge of the transfer sheet is judged to have arrived at the transfer position of transfer roller 8, and a step advances to ST14 without correcting the transfer sheet skew, while when tb is smaller than t2, the leading edge of the transfer sheet is judged not to have arrived at the transfer position of the transfer roller 8, and a step advances to ST12 to correct the transfer sheet skew.

(ST12)

This is a step to practice correction for the transfer attitude. Based on the skew angle θ, the amount of skew ΔY and the amount of deviation ΔX of the transfer sheet which are calculated by information control circuit 120 under the instructions of CPU 110, motors M1, M2 and M3 constituting the transfer attitude correcting section shown in FIG. 2 which is provided as a part of sheet-supply-ejection means 14 are operated properly by, for example, a correction operating program established in advance, thus, the base board BP together with the roller R2 is swung on rotation center BPC to correct the transfer sheet skew, and the roller R2 is shifted in its axial direction on the base board BP so as to correct the deviation ΔX, and a step advances to ST13.

(ST13)

This is a step to judge whether to terminate the transfer attitude correcting operations or not. Since it is possible to select whether to conduct repeated correction or not in the present embodiment, when the repeated correction is selected and set by operation input means 200 in advance, for example, the transfer attitude correcting operations to correct a skew and a deviation by measuring two points are repeated while tb does not exceed t2, namely, while a leading edge of the transfer sheet is judged not to have arrived at the transfer position on transfer roller 8, thus, counted value ta of timer counter Ta is reset to advance to ST3, while, when repeated correcting operations are not conducted, namely, when the transfer attitude correction is terminated only by conducting the single transfer attitude correcting operation a single time, a step advances to ST14.

(ST14)

This is a step to stop timer operations. When timer operations started to correct transfer attitude are stopped, or when operations of timer counters Ta and Tb which operate with regard to the timer are stopped, and processing to reset the time elapsed ta and tb which are counted is completed, the transfer attitude correcting operations are terminated.

(ST15)

This is a step to set roller R2 to its initial position. In this step, a position of roller R2 is set to its initial position in advance so that correcting operations for the transfer attitude may be carried out at any time when the roller R2 is not rotating, thus, the actions to set the roller R2 to its initial position are terminated.

Correction of the transfer attitude for transfer sheet relating to the invention has been explained above, referring to the present embodiment, and an object of the invention is to provide an image forming apparatus wherein control is simple, correction of the transfer attitude for transfer sheet can be repeated in the conveyance path from roller R2 up to the transfer position on the transfer roller as stated above, and high-definition images can be formed, and a structure of the transfer attitude correcting section, and a structure of a sensor means, or structures of control circuits are not limited to the present embodiment.

For judging whether a leading edge of the transfer sheet has arrived at a transfer position of the transfer roller or not, in particular, sensor S is used in the present embodiment, and when the sensor S detects the leading edge of the transfer sheet, information control circuit 120 calculates time t2 that is required by the leading edge of the transfer sheet to arrive at the transfer position of the transfer roller, to judge whether elapsed time tb by timer counter Tb satisfies a condition of tb<t2 or not, for controlling. However, it is also possible to provide separately a leading edge detection sensor that detects a leading edge of the transfer sheet, to detect a leading edge of the transfer sheet with the leading edge detection sensor, without using the timer counter.

Further, when correcting the transfer attitude of the transfer sheet repeatedly, a condition of tb<t2 is judged, and as far as this condition holds, correction can be carried out repeatedly. When selecting a repetition correction mode that corrects the transfer attitude of the transfer sheet repeatedly, it is possible either to arrange so that the number of measurement positions to be measured repeatedly and the frequency of measurements, or the frequency of correctable corrections may be established in advance, or to conduct correction operations for correcting the transfer attitude, after enhancing accuracy of a skew angle θ, an amount of skew ΔY or a deviation ΔX by repeating positional measurements, under some circumstances.

Incidentally, in the present invention, a position to be measured by a position measurement means is made to be plural positions which are located on a side edge on either one side of a transfer sheet that is located along the conveyance direction for a transfer sheet. Therefore, compared with a measuring method to measure a leading edge of a transfer sheet in course of conveyance, positions to be measured are not limited, and measurement can be repeated as occasion demands, thus, the transfer attitude of a transfer sheet can be detected and corrected, resulting in offering of an image forming apparatus wherein a transfer sheet is not skewed and does not deviate from a reference transfer position and images of high grade can be formed.

Further, a position measurement means is arranged in a transfer sheet conveyance path located between a transfer attitude correcting section and a transfer position where transfer is carried out on a transfer sheet, whereby, it is possible to repeat measurement and correction concerning the transfer attitude of a transfer sheet as occasion demands, and the transfer attitude of a transfer sheet can be detected and corrected at high accuracy. AS a result, it has become possible to provide an image forming apparatus wherein a transfer sheet is not skewed and does not deviate from a reference transfer position and images of high grade can be formed.

Since the time interval between measurement by a position measurement means for the first position and that for the second position is made to be changed depending on a conveyance speed for a transfer sheet and on a transfer sheet size, it is possible to detect and correct the transfer attitude of a transfer sheet at high accuracy with a position measurement means, without being restricted by the conveyance speed and by a size of a transfer sheet. Further, since the time intervals corresponding to the conveyance speed for the transfer sheet and to a size of the transfer sheet are made to be stored in a memory means, it is possible to change the time interval for measurement easily, and it has become possible to provide an image forming apparatus wherein a transfer sheet is not skewed and does not deviate from a reference transfer position and images of high grade can be formed.

Further, the first transfer skew correcting section is structure such that when the leading end of a transfer sheet P bumps against the roller R2 and stops to form a loop, a skew of the transfer sheet can be preliminarily corrected, and further the second transfer skew correcting section is structured in the transfer attitude correcting section such that a slight skew or the transfer sheet which was not corrected by the first transfer sheet skew correction means and a skew of the transfer sheet caused in the course of conveyance after the first transfer sheet skew correction means can also be corrected, and it has become possible to provide an image forming apparatus wherein a transfer sheet is not skewed and does not deviate from a reference transfer position and images of high grade can be formed.

Though the image forming apparatus has been explained referring to the example of a copying machine employing a transfer sheet as a recording material, it is natural that an image forming apparatus may also be a facsimile machine or a printer, without being limited to the copying machine.

What is claimed is:

1. An image forming apparatus, comprising:

an image carrying member for carrying a toner image while rotating;

a transfer section for transferring the toner image from the image carrying member to a transfer sheet;

a transfer attitude correcting section for correcting a transfer attitude of the transfer sheet to receive the toner image and for conveying the corrected transfer sheet to the transfer section with a timing to match with the movement of the toner image;

wherein the transfer attitude correcting section comprises:

a roller unit including a base board rotatable around a center of rotation and a registration roller mounted on the base board, a detecting section for detecting a position of the transfer sheet being conveyed by the registration roller; and a control section for control the roller unit based on detection data detected by the detecting section so as to correct a skew of the transfer sheet by rotating the base board and to correct a deviation of a transfer position of the transfer sheet by shifting the registration roller on the base board, wherein the detecting section detects a first point and a second point on a side of the transfer sheet locating along the conveying direction of the transfer sheet with a predetermined time interval Δt, the control section calculates an amount of the skew of the transfer sheet based on the detection data of the first and second points and controls the roller unit based on the amount of the skew, and wherein the registration roller is adapted to change the conveying speed into plural different conveying speeds, the detecting section changes the time interval Δt in accordance with a conveying speed so as to make the distance in the conveying direction of the transfer sheet between the first and second points to be constant regardless of the conveying speed.

2. The image forming apparatus of claim 1, wherein the roller unit further includes a rotating mechanism to rotate the base board, a driving mechanism for driving the registration roller, and a shifting mechanism for shifting the registration roller in a direction perpendicular to a conveying direction for the transfer sheet.

3. The image forming apparatus of claim 2, wherein the control section controls the roller unit to correct the skew of the transfer sheet and the deviation of a transfer position of the transfer sheet on the base board while the registration roller conveys the transfer sheet to be corrected.

4. The image forming apparatus of claim 1, wherein the detecting section comprises a line sensor to detect at least two positions of the transfer sheet along a direction perpendicular to the conveying direction of the transfer sheet.

5. The image forming apparatus of claim 1, wherein the line sensor is provided at an exit side of the registration roller.

6. The image forming apparatus of claim 1, wherein the control section controls the registration roller to change the conveying speed in accordance with the size of the transfer sheet and controls the detecting section to change the time interval Δt in accordance with the size of the transfer sheet.

7. The image forming apparatus of claim 6, wherein the control section comprises a memory to store at least one of first data which include plural different conveying speeds and plural different time intervals Δt corresponding to the plural different conveying speeds and second data which include plural different sheet sizes and plural different time intervals Δt corresponding to the plural different sheet sizes.

8. The image forming apparatus of claim 1, wherein the control section controls the detecting section to detect the first point at a time t0 after the detecting section detects a leading end of the transfer sheet.

9. The image forming apparatus of claim 8, wherein the control section controls the detecting section to change the time t0 in accordance with the size of the transfer sheet.

10. The image forming apparatus of claim 1, wherein the control section controls the detecting section to detect the position of the transfer sheet plural times before the transfer sheet arrives the transfer section and control the roller unit to correct the transfer attitude plural times.

11. The image forming apparatus of claim 1, wherein the control section calculates the deviation of the transfer position of the transfer sheet based on the detection data of the first and second points and controls the roller unit so as to correct the deviation of the transfer position of the transfer sheet.

12. The image forming apparatus of claim 1, further comprising a sheet feeding roller to convey the transfer sheet to the registration roller in the transfer attitude correcting section, wherein when the sheet feeding roller conveys the transfer sheet to the registration roller, the control section stops the rotation of the registration roller so that the transfer sheet bumps a leading end thereof against the stopped registration roller and a skew of the transfer sheet is corrected preliminarily.

13. An image forming apparatus, comprising:

an image carrying member for carrying a toner image while rotating;

a transfer section for transferring the toner image from the image carrying member to a transfer sheet;

a transfer attitude correcting section for correcting a transfer attitude of the transfer sheet to receive the toner image and for conveying the corrected transfer sheet to the transfer section with a timing to match with the movement of the toner image;

wherein the transfer attitude correcting section comprises:

a roller unit including a base board rotatable around a center of rotation and a registration roller mounted on the base board, a detecting section for detecting a position of the transfer sheet being conveyed by the registration roller; and a control section for control the roller unit based on detection data detected by the detecting section so as to correct a skew of the transfer sheet by rotating the base board and to correct a deviation of a transfer position of the transfer sheet by shifting the registration roller on the base board, wherein the detecting section detects a first point and a second point on a side of the transfer sheet locating along the conveying direction of the transfer sheet with a predetermined time interval Δt, the control section calculates an amount of the skew of the transfer sheet based on the detection data of the first and second points and controls the roller unit based on the amount of the skew, wherein the control section controls the detecting section to detect the first point at a time t0 after the detecting section detects a leading end of the transfer sheet, and wherein the control section controls the detecting section to change the time t0 in accordance with the size of the transfer sheet.

* * * * *